United States Patent [19]

Mitani et al.

[11] Patent Number: 4,538,145

[45] Date of Patent: Aug. 27, 1985

[54] DATA TRANSFER CONTROL DEVICE

[75] Inventors: Ryo Mitani, Yokohama; Yoshiaki Moriya; Atsushi Kobayashi, both of Tokyo, all of Japan

[73] Assignee: Tokyo Shibaura Denki Kabushiki Kaisha, Japan

[21] Appl. No.: 433,711

[22] Filed: Oct. 12, 1982

[30] Foreign Application Priority Data

Oct. 15, 1981 [JP] Japan ..... 56-164706

[51] Int. Cl.[3] ..... G09G 1/00; G09G 3/00

[52] U.S. Cl. ..... 340/805; 340/802; 340/801; 340/825.51

[58] Field of Search ..... 340/718, 719, 800, 801, 340/802, 805, 825.51, 825.52, 706; 375/36

[56] References Cited

U.S. PATENT DOCUMENTS 4,016,369 4/1977 Pedersen ..... 340/825.52 X
4,227,193 10/1980 Shanks ..... 340/784
4,253,087 2/1981 Saal ..... 340/825.52

*Primary Examiner*—Marshall M. Curtis
*Assistant Examiner*—Vincent P. Kovalick
*Attorney, Agent, or Firm*—Finnegan, Henderson, Farabow, Garrett & Dunner

[57] ABSTRACT

A data transfer control device is provided having a plurality of shift registers connected through said multiplexers in a closed loop, a selector connected to the inputs of said multiplexer and for selecting a transfer destination of display data according to a common electrode select signal of a display unit, and a gate for selecting the polarity of the display data to be loaded into said shift registers according to the polarity of common output signals for scanning common electrodes of said display unit.

3 Claims, 48 Drawing Figures

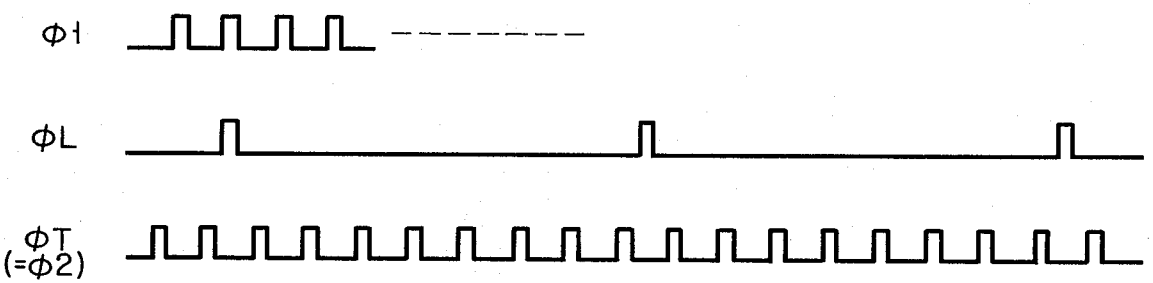
FIG. 3A (PRIOR ART)
FIG. 3B (PRIOR ART)
FIG. 3C (PRIOR ART)
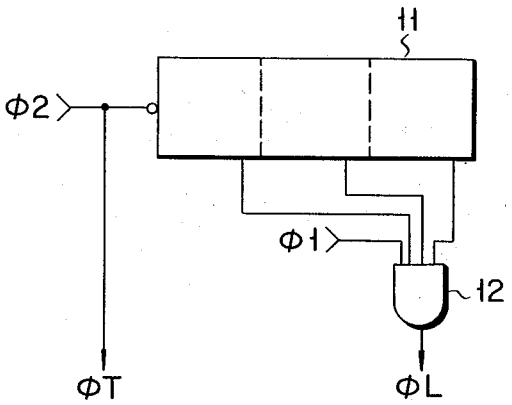
FIG. 4 (PRIOR ART)

FIG. 7I (PRIOR APT)

FRAME FREQUENCY
d0
d1
d2
d3
w
$V_{DD}$
$2V_{DD}/3$
$V_{DD}/3$
0
COMO
ℓ
k

DATA TRANSFER CONTROL DEVICE

BACKGROUND OF THE INVENTION

The present invention relates to a data transfer control device adaptable for transferring display data to a liquid crystal drive circuit for directly driving a liquid crystal display unit of a dynamic drive type.

FIG. 1 shows a prior liquid crystal drive circuit with a duty ratio of $\frac{1}{4}$ and with 8-segment outputs. In the drive circuit, a closed loop is formed including four 8-bit shift registers $1_0$ to $1_3$ connected in a cascade fashion, an inverter 2 for AC-driving a liquid crystal display 6 unit to be described later, and a multiplexer 4. An output signal from a parallel/serial converter circuit 3 for converting parallel data into serial data is transferred to the multiplexer (selector) 4.

The multiplexer 4, controlled by a control signal a supplied from a central processing unit (CPU) (not shown), selects the data from the parallel/serial converter circuit 3 and the inverter 2. The shift register $1_0$ is connected at the 8-bit output terminals to a latch/-driver circuit 5. The latch/driver circuit 5 converts the parallel data derived from the shift register $1_0$ into segment signals $SEG_0$ to $SEG_7$ for directly driving a liquid crystal display unit 6. The liquid crystal display unit 6 is connected to the output terminals of the latch/drive circuit 5. The 8-segment liquid crystal display 6 displays four figures at the duty ratio of $\frac{1}{4}$ under control of common electrode drive signals COM0 to COM3 generated from a common signal generator 7 to specify a segment to be displayed.

A clock signal generator 8 generates clock signals $\phi T$ and $\phi L$ and applies them to the shift register $1_0$ and the latch/driver 5. The clock generator 8 is made up of a frequency divider 11 and an AND gate 12, as shown in FIG. 4. Fundamental clock signals $\phi 1$ and $\phi 2$ are generated by another clock signal generator (not shown). The clock signal $\phi 1$ is applied to one of the input terminals of the AND gate 12. The clock signal $\phi 2$ is applied in an inverted state to the frequency divider 11, and is appplied in a non-inverted state to the shift register $1_0$. The signals at different frequencies are applied from the frequency divider 11 to the remaining input terminals of the AND gate 12. The AND gate 12 responds to the clock signal $\phi 1$ to produce the clock signal $\phi L$ for transferring to the latch/driver 5. One clock signal $\phi L$ is produced every time eight pulses of the clock signal $\phi T$ are produced.

FIG. 5 shows an example of the common signal generator 7 for generating common electrode drive signals COM0 to COM3. The common signal generator 7 includes p-channel MOS transistors TR7 and TR8 and n-channel MOS transistors TR9 and TR10, all of which have the current paths which are connected in series between power source terminals VD and VL. Generator 7 also has p- and n-channel MOS transistors TR11 and TR12 connected in parallel between a node coupled to a resistor R2 and a resistor R3 and a node coupled to the MOS transistor TR8 and the MOS transistor TR9. NAND gate 121 applied with a first common electrode select signal d0 and a blanking signal $\overline{BLK}$.

The gates of the MOS transistors TR7 and TR10 are connected through an inverter 122 to a control terminal WCLT. The gates of the MOS transistors TR8 and TR12 are connected together to the output terminal of the NAND gate 121. The gates of the MOS transistors TR9 and TR11 are connected through an inverter 124 to the output terminal of the NAND gate 121 having as inputs a first common electric signal do and a blanking signal BLK.

A 0-th common electrode drive signal COM0 is produced from a node between the MOS transistors TR8 and TR9. The circuit arrangements of the remaining circuit sections 125, 126 and 131 are each substantially the same as that of the circuit section 127. These circuit sections 125, 126 and 131, respectively, produce the first to third common electrode drive signals COM1 to COM3 in response to the output signals from NAND gates 128, 129 and 132 which receive at the first input terminals a blanking signal $\overline{BLK}$ and at the second input terminals the first to third common electrode select signals d1 to d3.

FIG. 6 shows a time-division control circuit in which four D-type flip-flops $21_0$ to $21_3$ connected in a cascade fashion make up a ring counter. In the figure, the Q output terminal of the flip-flop $21_0$ is connected to a D input terminal of the succeeding stage flip-flop $21_1$ of which the Q output terminal is connected to the D input terminal of the succeeding flip-flop $21_2$. The Q output terminal of the flip-flop $21_2$ is connected to the D input terminal of the flip-flop $21_3$. The Q output signals from the flip-flops $21_0$ to $21_3$ are sent as common electrode select signals d0 to d3. The signals d0 to d2 of these common electrode select signals are supplied through an OR gate 22 and an inverter 25 to the D input terminal of the flip-flop $21_0$.

The clock signal $\phi L$ is applied to the clock terminals CK of the flip-flops $21_0$ through $21_3$ and a clear signal is applied to the clear terminals CL of the same flip-flop.

The time division control circuit under discussion is further provided with a circuit for generating a PHASE signal and a polarity inverting signal W. An output signal CTL of the OR gate 22 is applied to one of the input terminals of a XNOR gate 24. The output signal from the XNOR gate 24 is produced as the PHASE signal and is also applied to a D-type flip-flop 23. The clear terminal CL and the clock terminal CK of the flip-flop 23 are supplied with the clear signal and the clock signal $\phi L$, respectively. The polarity inverting signal W is derived from the Q output terminal of the flip-flop 23 and is applied to the other input terminal of the XNOR gate 24.

FIGS. 7A to 7F show timing diagrams of input signals applied to the time division control circuit and output signals produced from the same circuit. At the timing of the clock signal $\phi L$ shown in FIG. 7B, the CTL signal shown in FIG. 7D, after being inverted by the inverter 25, is applied to the D input terminals of the flip-flops $21_0$ through $21_3$, thereby to provide the signals d0 to d3 shown in FIG. 7C. The CTL signal is at a high level so long as the signals d0 to d2 are logic "1". When the signal d3 is logic "1", the signals d2 through d0 are all logic "0". These signals are applied to the OR gate 22, so that the CTL signal as the output signal from the OR gate 22 is at low level, as shown in FIG. 7D. As a result, the CTL signal at a low level is applied to one of the input terminals of the XNOR gate 24 and the polarity inverting signal at low level, after being inverted, is applied to the other input terminals of the XNOR gate 24. Therefore, the XNOR gate 24 produces the PHASE signal at high level.

The output signal from the XNOR gate 24 is further latched in the flip-flop 23. When any one of the common electrode select signals d0 to d2 is at high level, the CTL signal is at high level. Accordingly, the XNOR gate 24 produces a PHASE signal at high level, so that the PHASE signal as shown in FIG. 7E is obtained. As a result, the inverting signal W becomes a signal as shown in FIG. 7F which is the PHASE signal delayed a fixed time. The common electrode select signals d0 through d3 are applied to the common electrode drive signal generator circuit of FIG. 5, thereby forming the common electrode drive signals COM0 to COM3 as shown in FIGS. 7G through 7J.

FIG. 2 shows another example of a prior art liquid crystal drive circuit. In this example four shift registers $1_0$ to $1_3$ are connected in a cascade fashion. Multiplexers $4_0$ through $4_3$ are provided so as to write data of 4 bits from the CPU to the shift registers $1_0$ to $1_3$. One-bit signals are applied to each of the input terminals of these multiplexers $4_0$ through $4_3$. The output signals from the shift register $1_3$ are applied to the other input terminal of the multiplexer $4_0$; the output signal from the shift register $1_2$ to the other input terminal of the multiplexer $4_1$; the output signal from the shift register $1_1$ to the other input terminal of the multiplexer $4_2$ through the inverter 2; the output signal from the shift register $1_0$ to the other input terminal of the multiplexer $4_3$.

The shift register $1_0$ is connected through the latch/-driver circuit 5 to the liquid crystal display unit 6. The fundamental clock signal $\phi$T is applied to the shift registers $1_0$ through $1_3$ and the clock signal $\phi$L is supplied to the latch/driver circuit 5. The common electrode drive signals COM0 to COM3 are applied from the common electrode drive signal generator 7 to the liquid crystal display 6. A control signal al for selecting the data from the CPU or the data from the shift registers $1_0$ through $1_3$ is applied to the multiplexers $4_0$ to $4_3$.

FIG. 8 is a block diagram illustrating an interconnection of the liquid crystal drive circuit shown in FIG. 2 with a microcomputer (CPU) 31 for supplying display data to the liquid crystal drive circuit. In the figure, the common electrode drive signal generator 32 transfers a display data transfer ready signal l shown in FIG. 10G to the CPU 31 and a transfer data inverting control signal K to the multiplexer 33. Further, the circuit 32 transfers the common electrode drive signals COM0 to COM3 to the liquid crystal (LC) display 6, through transfer lines 35.

FIG. 9A illustrates a figure including eight segments a to h of a digit used in the display unit 6. FIG. 9B shows a format of a segment specifying buffer containing fields for specifying the data representing the segments of the figure shown in FIG. 9A. Since the present examples use a 4-bit microprocessor, two stages of 4-bit segment specifying buffer are used for specifying the 8-segment data. As shown, bit 0 corresponds to the common electrode drive signal COM0; bit 1 to the drive signal COM1; bit 2 to the drive signal COM2; bit 3 to the drive signal COM3.

As shown in FIGS. 10A to 10J, when the common electrode select signals d0 to d2 are at low level and the select signal d3 is at high level, the data transfer ready signal l shown in FIG. 10G is at high level. As a result, the data transfer signal as shown in FIG. 10I is produced. The CPU 31 acknowledges the reception of the transfer ready signal l, and at the time of the high level of the signal d3, transfers the data corresponding to the signal COM0 to the shift register $1_0$, the data corresponding to the signal COM1 to the shift register $1_2$, the data corresponding to the signal COM2 to the shift register $1_2$, and the data corresponding to the signal COM3 to the shift register $1_1$. Thus, in the prior liquid crystal drive circuit, a fixed timing relationship is established between the common electrode drive signals COM0 to COM3 and the transfer data. This fixed timing relationship frequently hinders correct LC display operation. In other words, there is poor flexibility in setting up the transfer timing of the display data. Therefore, when the frame frequency shown in FIG. 10A is 100 Hz, the CPU must wait a maximum of 10 ms till data transfer is permitted.

SUMMARY OF THE INVENTION

Accordingly, an object of the present invention relates to a data transfer control device with improved flexibility in setting up a transfer timing of data and an improved transfer efficiency of data.

In a data transfer control device according to the present invention, a selector for selecting a transfer port of the display data is provided in display data transfer lines connecting to the multiplexers. With the provision of the selector, the data transfer is allowed at a desired timing. Therefore, the data transfer processing is relatively independent of the program, thereby improving data transfer efficiency.

BRIEF DESCRIPTION OF THE DRAWINGS

Other objects and features of the present invention will be apparent from the following description taken in conjunction with the accompanying drawings, in which:

FIGS. 3A through 3C include timing diagrams illustrating sequential operations of the liquid crystal drive circuits of FIGS. 1 and 2, in which FIG. 3A shows a waveform of a fundamental timing signal $\phi$1, FIG. 3B a waveform of a clock signal $\phi$L for display latch, and FIG. 3C a waveform of a clock signal $\phi$T for shifting shift registers;

FIG. 4 is a schematic block diagram of a circuit for generating the clock signals $\phi$L and $\phi$T shown in FIGS. 3B and 3C;

FIGS. 7A through 7J include timing diagrams illustrating a set of waveforms of signals formed by a time division control circuit shown in FIG. 6, in which FIG. 7A shows a waveform of a clock signal $\phi$T for shifting shift registers, FIG. 7B a waveform of clock signal $\phi$L for a display latch, FIG. 7C waveform of common electrode select signals d0 to d3 produced from the time division control circuit shown in FIG. 6, FIG. D a waveform of a CTL signal produced from the same circuit, FIG. 7E a waveform of a polarity inverting preparatory signal PHASE, FIG. 7F a waveform of a polarity inverting signal W, and FIGS. 7G to 7J waveforms of common electrode drive signals COM0 to COM3;

FIGS. 10A through 10J include timing charts illustrating a transfer state of display data in which FIGS. 10A to 10D illustrate common electrode select signals d0 to d3, FIG. 10E a waveform of a polarity inverting signal, FIG. 10F a waveform of a COM0 signal, FIG. 10G a waveform of a transfer ready signal 1, FIG. 10 a waveform of a transfer data inversion control signal K, FIG. 10I a waveform of a transfer data signal from a CPU, and FIG. 10J, a waveform of a display data signal;

FIGS. 13A to 13I show waveforms of signals used in the FIG. 12 circuit, in which FIG. 13A shows a polarity inverting signal, FIGS. 13B to 13E waveforms of common electrode select signals d0 to d3, and FIGS. 13F to 13H waveforms of common electrode drive signals COM0 to COM3; and FIGS. 14A through 14F are timing charts illustrating a transfer state of display data, in which FIGS. 14A to 14D shows waveforms of segment electrode select signals, FIG. 14E a waveform of a transfer data signal from a CPU, and FIG. 14F a waveform of a display data signal.

DETAILED DESCRIPTION OF THE PREFERRED EMBODIMENTS

Figure 1:
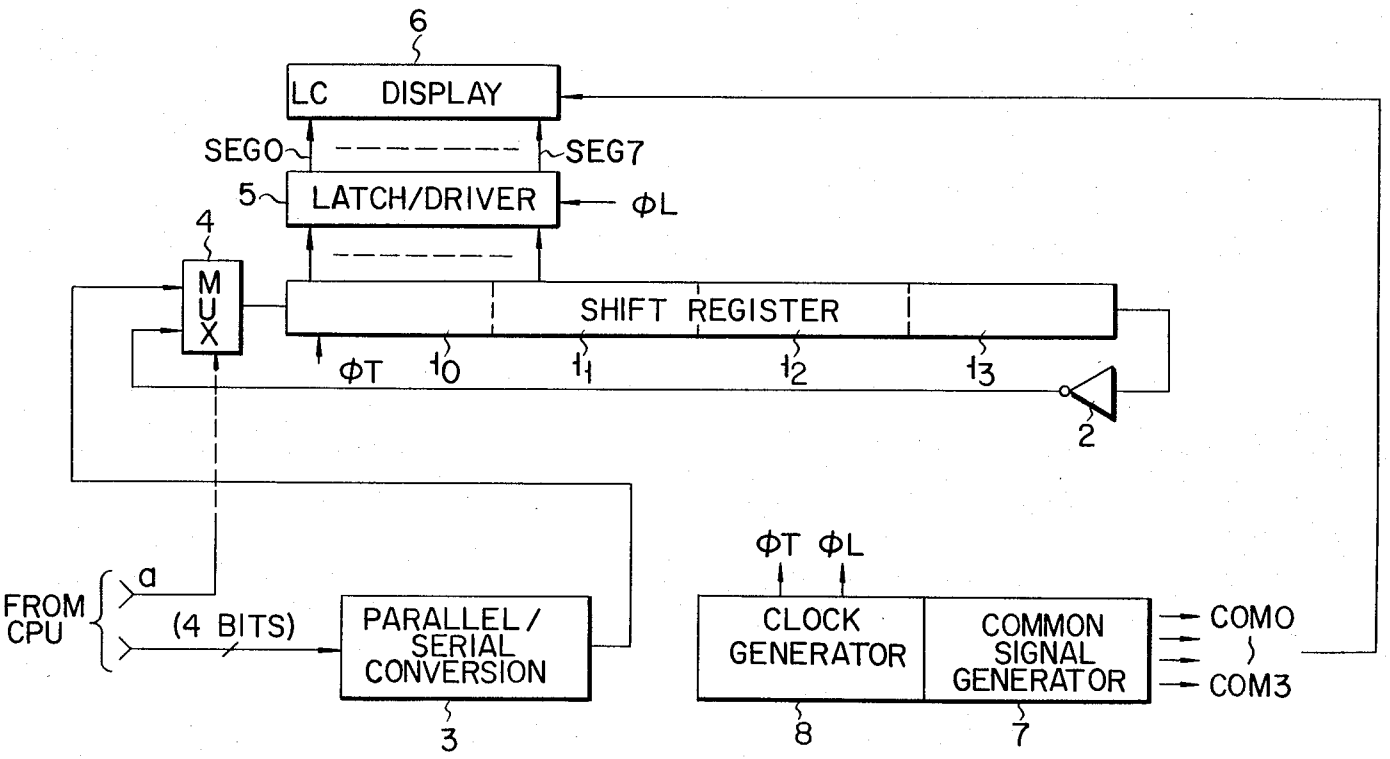
FIG. 1 (PRIOR ART)
FIGS. 1 and 2 are block diagrams of prior art liquid crystal drive circuits.
Figure 2:
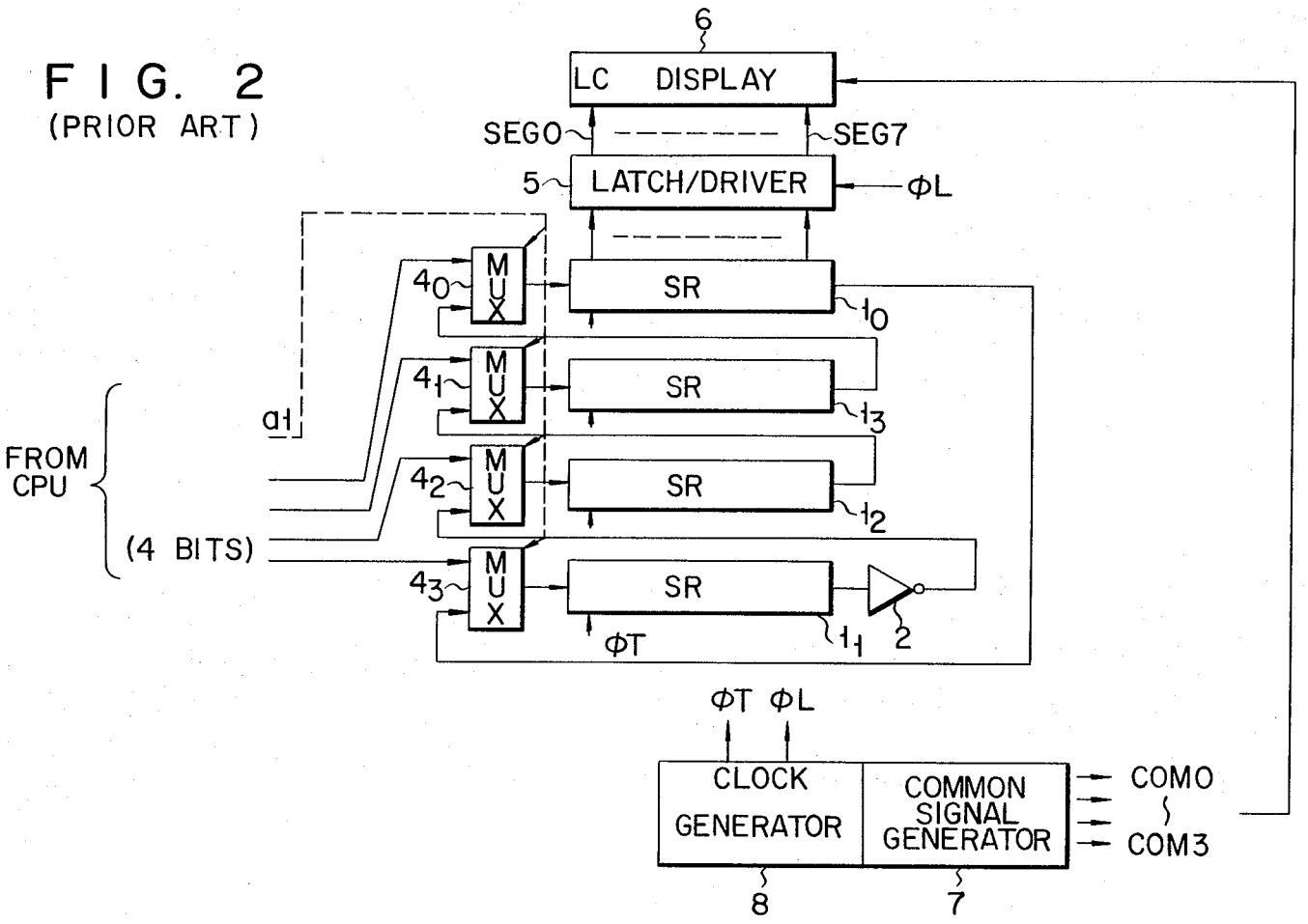
FIG. 2 (PRIOR ART)
Figure 5:
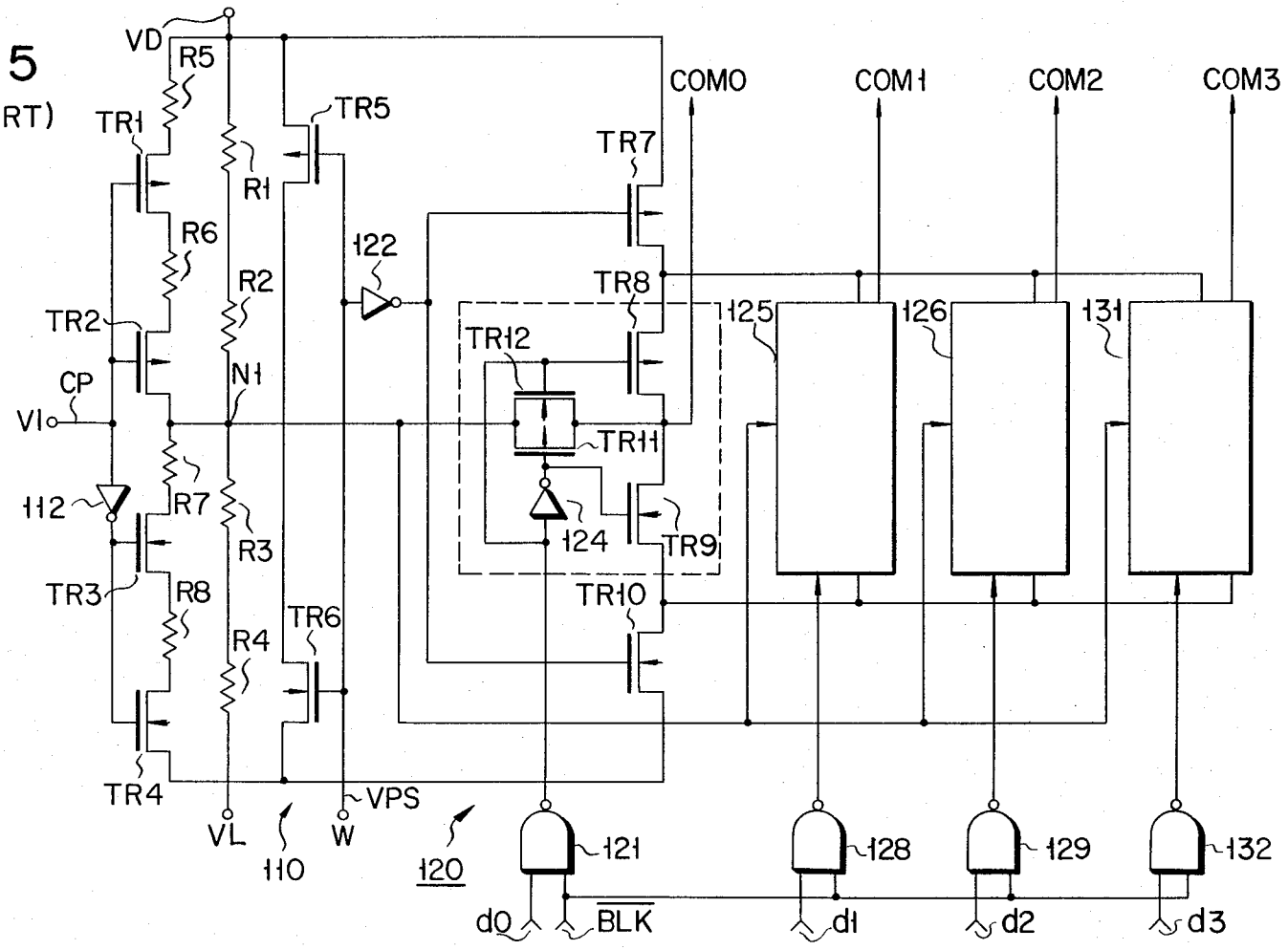
FIG. 5 (PRIOR ART)
FIG. 5 is a circuit diagram of a common electrode drive signal generator circuit used in the circuit shown in FIGS. 1 and 2.
Figure 6:
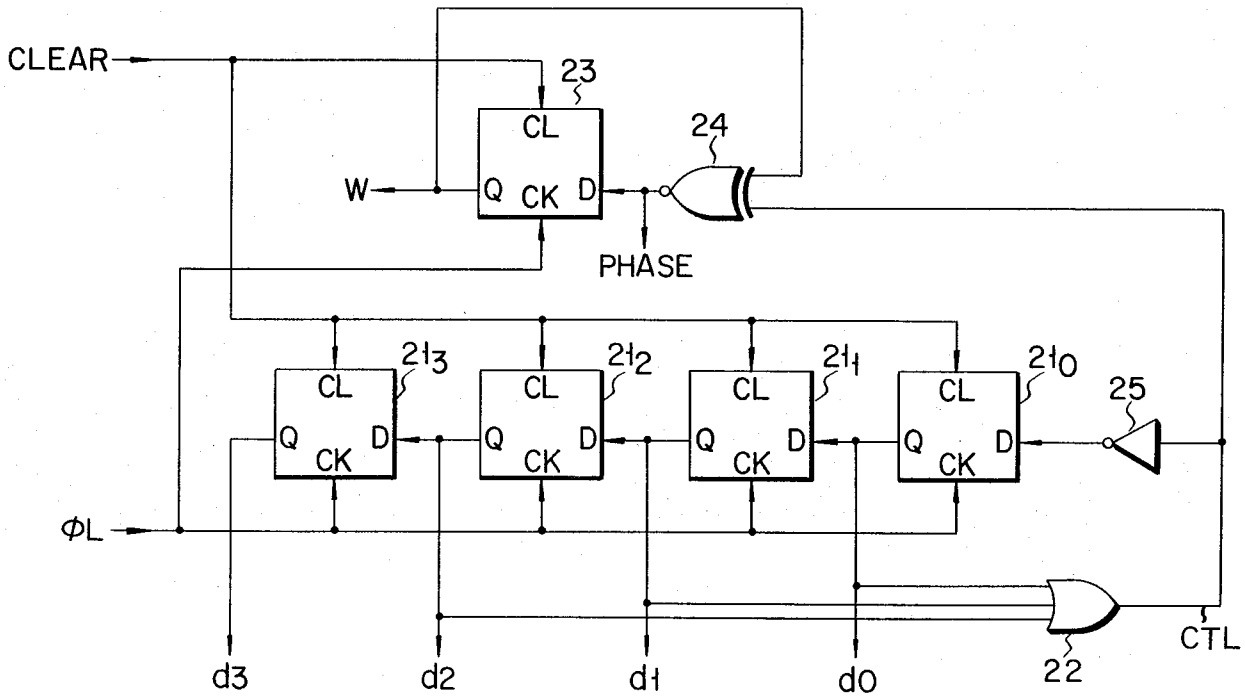
FIG. 6 (PRIOR ART)
FIG. 6 is a circuit diagram of a time division control circuit necessary for the liquid crystal drive circuits shown in FIGS. 1 and 2.
Figures 7A, 7B, 7C, 7D, 7E, 7F, 7G, 7H, 7J:
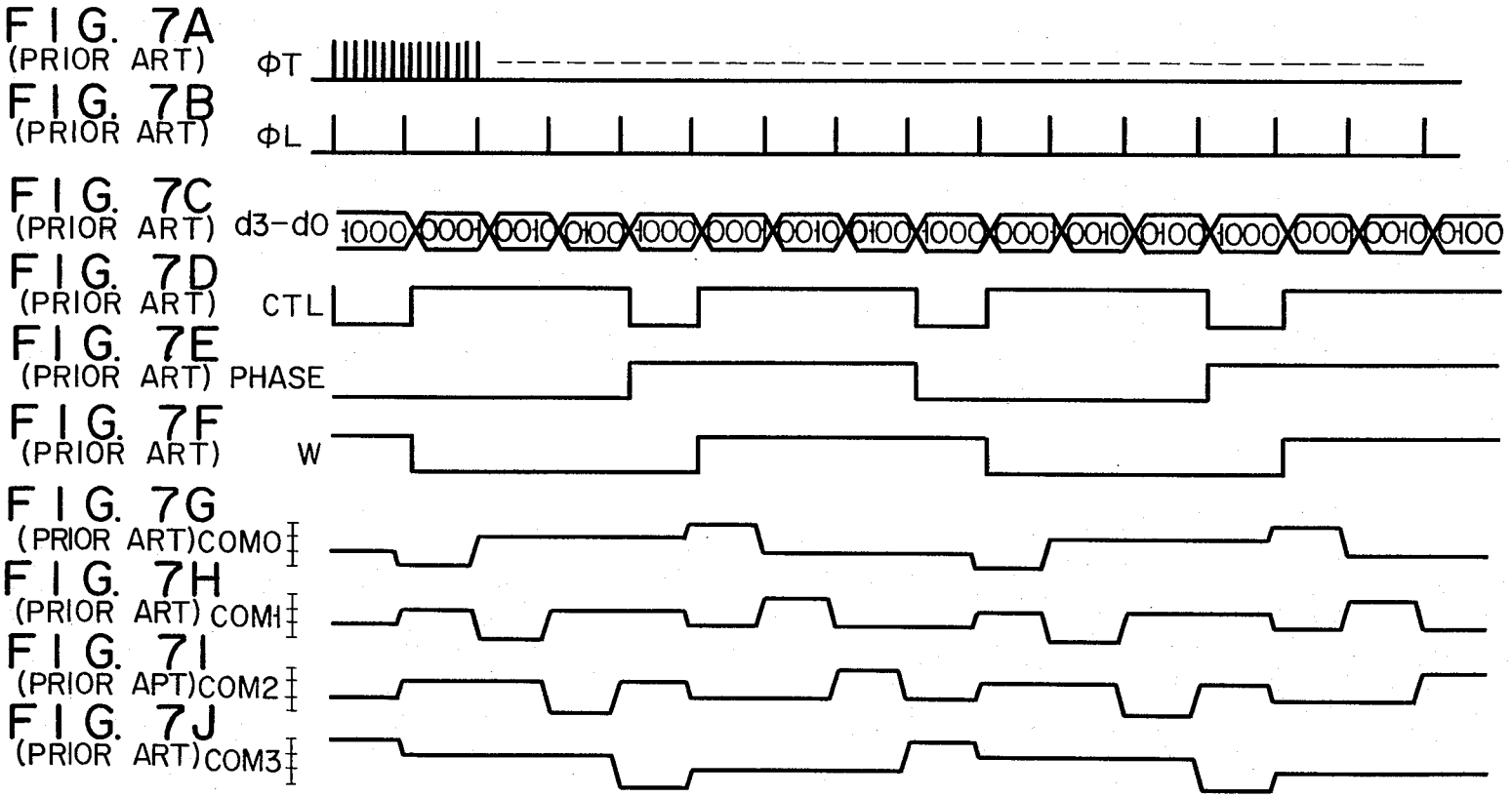
FIG. 7A (PRIOR ART)
FIG. 7B (PRIOR ART)
FIG. 7C (PRIOR ART)
FIG. 7D (PRIOR ART)
FIG. 7E (PRIOR ART)
FIG. 7F (PRIOR ART)
FIG. 7G (PRIOR ART)
FIG. 7H (PRIOR ART)
FIG. 7J (PRIOR ART)
Figure 8:
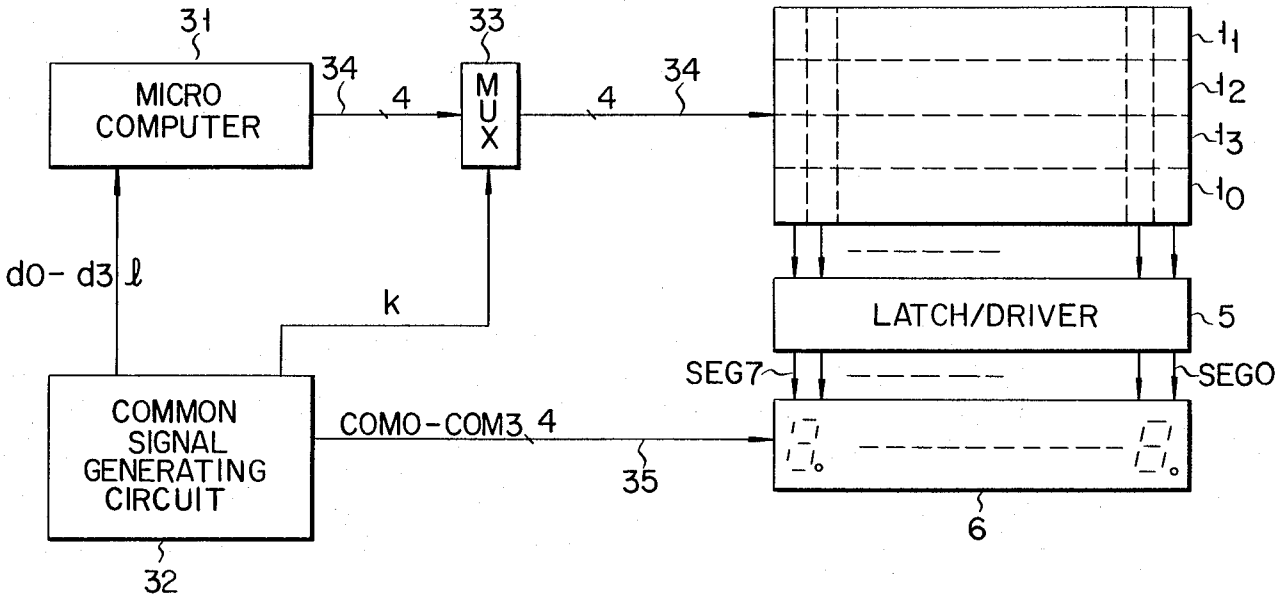
FIG. 8 (PRIOR ART)
FIG. 8 is a block diagram of a prior circuit arrangement for driving the liquid crystal drive circuit shown in FIG. 2 by a microcomputer.
Figure 9A:
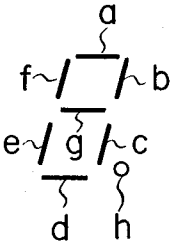
FIG. 9A (PRIOR ART)
FIG. 9A illustrates a figure made up of eight segments a to h located at a digit space of the liquid crystal display.
Figure 9B:
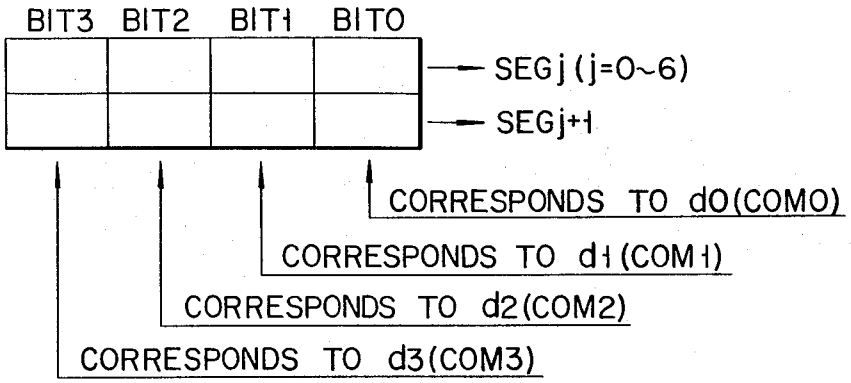
FIG. 9B (PRIOR ART)
FIG. 9B shows a format of a segment specifying buffer for specifying the data representing segments of the figure.
Figures 10A, 10B, 10C, 10D, 10E, 10F, 10G, 10H, 10I, 10J:
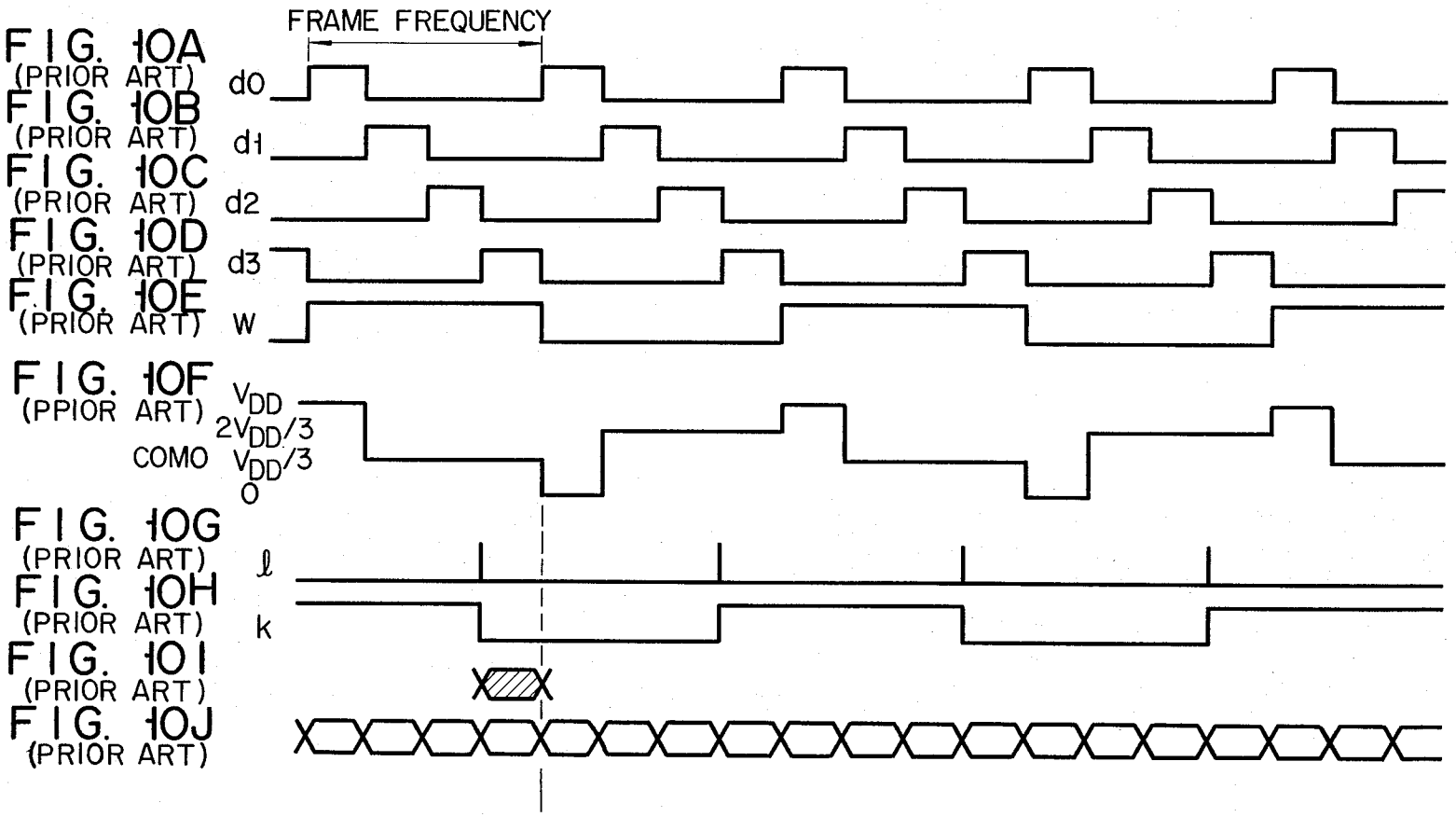
FIG. 10A (PRIOR ART)
FIG. 10B (PRIOR ART)
FIG. 10C (PRIOR ART)
FIG. 10D (PRIOR ART)
FIG. 10E (PRIOR ART)
FIG. 10F (PRIOR ART)
FIG. 10G (PRIOR ART)
FIG. 10H (PRIOR ART)
FIG. 10I (PRIOR ART)
FIG. 10J (PRIOR ART)
Figure 11:
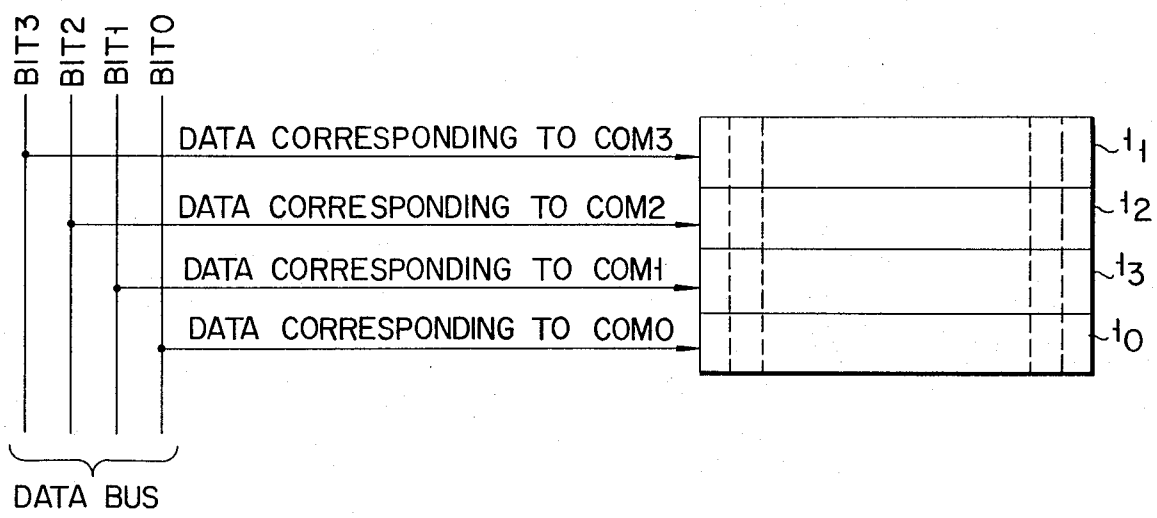
FIG. 11 (PRIOR ART)
FIG. 11 shows the interrelation of common output signals and shift registers $1_0$ to $1_3$ in the FIG. 8 circuit.
Figure 12:
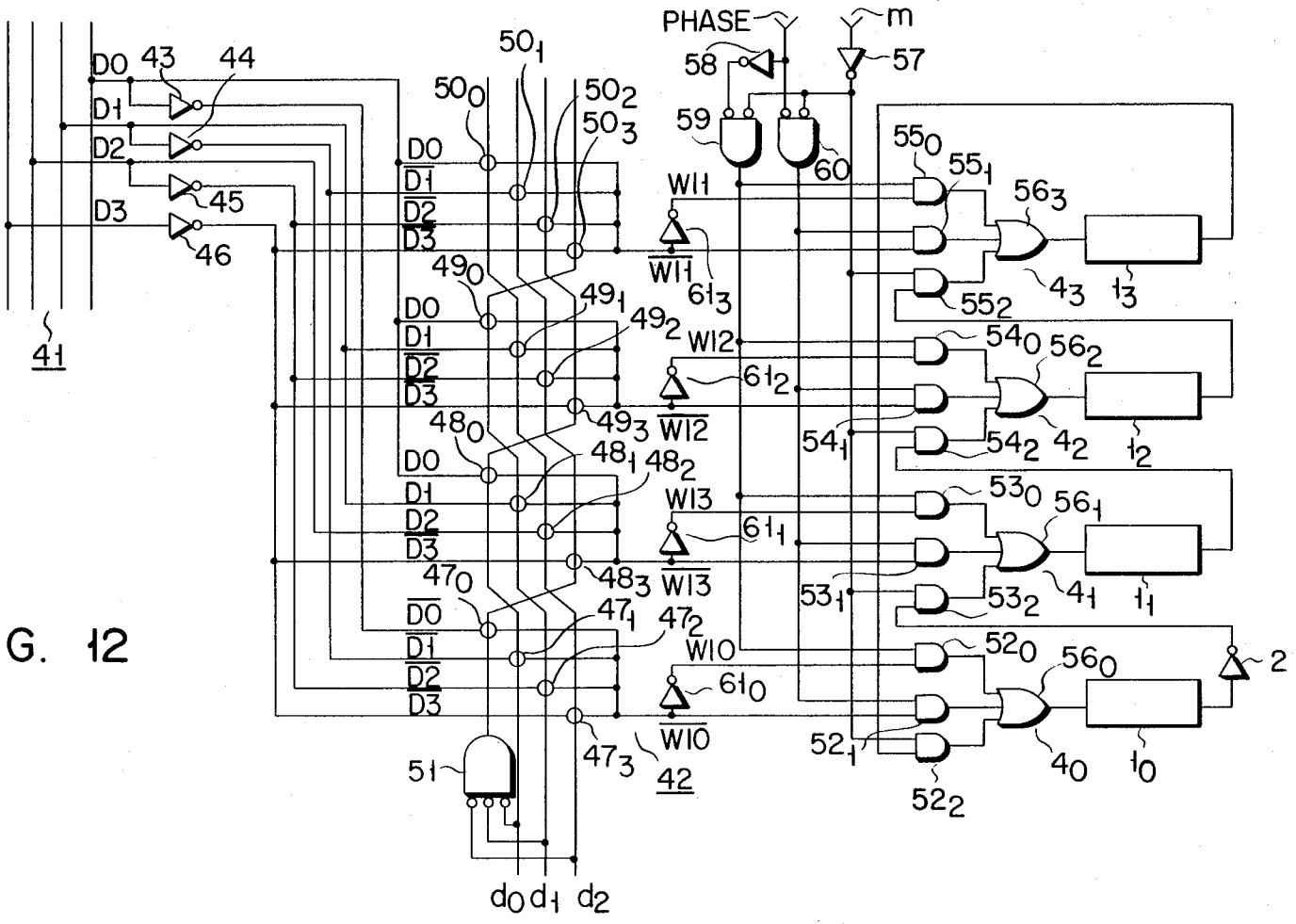
FIG. 12 shows a circuit diagram of an embodiment of a data transfer device according to the present invention.

FIG. 12 shows an embodiment of a data transfer control device according to the present invention. In the figure, like numerals are used to indicate like portions in FIG. 2. In the present embodiment, a selector 42 for selecting a transfer destination of the data transferred to the shift registers $1_0$ to $1_3$ is provided in the display data transfer path from the data bus 41 of the CPU to the multiplexers $4_0$ to $4_3$. The selector 42 is made up of groups of gates $47_0$ to $47_3$, $48_0$ to $48_3$, $49_0$ to $49_3$, and $50_0$ to $50_3$. A display data signal is applied to the gates $50_0$, $49_0$, and $48_0$. The inverted signal $\overline{D_0}$ from an inverter 43 coupled at the input with the signal $D_0$ is supplied to the gate $47_0$. A signal D1 is applied to the gates $49_1$ to $48_1$ and its inverted signal $\overline{D_1}$ derived from an inverter 44 is applied to the gates $50_1$ and $47_1$. A $D_2$ signal is applied to the gate $48_2$ and its inverted signal $\overline{D_2}$ from an inverter 45 is applied to the gates $50_2$, $49_2$ and $47_2$. An inverted signal $\overline{D_3}$ from an inverter 46 is applied to the gates $50_3$, $49_3$, $48_3$ and $47_3$. The gates $47_0(\overline{D_0})$, $48_3(\overline{D_3})$, $49_2(\overline{D_2})$ and $50_1(\overline{D_1})$, the gates $47_1(\overline{D_1})$, $48_0(D_0)$, $49_3(\overline{D_3})$ and $50_2(\overline{D_2})$, the gates $47_2(\overline{D_2})$,. $48_1(D_1)$ and $49_0(D_0)$, $50_3(D_3)$ and the gates $47_3(\overline{D_3})$, $48_2(D_2)$, $49_1(D_1)$ and $50_0(D_0)$ constitute first to fourth gate groups, respectively.

As shown, a common electrode select signal d0 is applied to the 2nd gate group; a common electrode select signal d1 to the 3rd gate group; a common electrode select signal d2 to the 4th gate group; and ANDed signal of these signals d0 to d2 (passed through a three-negative input AND gate 51) is applied to the first gate group. The multiplexer $4_0$ is made up of three AND gates $52_0$ to $52_2$ and an OR gate $56_0$ connected at the input to these three AND gates. The remaining multiplexers $4_1$ to $4_3$ have each a similar circuit arrangement to that of the multiplexer $4_0$. The output signals from these multiplexers $4_0$ to $4_3$ are applied to the shift registers $1_0$ to $1_3$, respectively.

An output signal from a shift register $1_0$ is applied through an inverter 2 to one of the input terminals of the AND gate $53_2$; an output signal from the shift register $1_1$ to one of the input terminals of the AND gate $54_2$; an output signal from the shift register $1_2$ to one of the input terminals of the AND gate $55_2$; an output signal from the shift register $1_3$ to one of the input terminals of the AND gate $52_2$. The data signals from the 1st to 4th gate groups are respectively applied to first input terminals of the AND gates $52_1$, $53_1$, $54_1$ and $55_1$, and through inverters $61_0$ to $61_3$ to first input terminals of the AND gates $52_0$ to $55_0$.

A display/transfer signal m is applied to the second input terminals of the AND gates $52_2$ to $55_2$, through an inverter 57. An output signal from a two-negative input AND gate 60 is applied to the second input terminal of the AND gates $52_1$ to $55_1$. An output signal from a two-negative input AND gate 59 is applied to the AND gates $52_0$ to $55_0$. The display/transfer signal m is applied through the inverter 57 to the first input terminals of AND gates 59 and 60.

When the display/transfer signal m is logic "0", a data display is going on, while when it is logic "1", a data transfer is going on. The polarity inverting preparatory signal PHASE is directly applied to the second input terminal of the AND gate 60, and applied through an inverter 58 to the second input terminal of the AND gate 58. With such a circuit arrangement, when the signal m is logic "1" and the signal PHASE is logic "0", if the data is transferred at the timing of the signal d3, the gates of the first gate group are enabled to allow the data $\overline{D_0}$ to go to the shift register $1_0$, the data $\overline{D_3}$ to go to the shift register $1_1$, the data $\overline{D_2}$ to go to the shift register $1_2$, and the data $\overline{D_1}$ to go to the shift register $1_3$.

At the other timings d0 to d2, the data are transferred to the shift registers $1_0$ to $1_3$ in a similar process. When the signal m is logic "1" and the signal PHASE is logic "1", if the data is transferred at the timing of the signal d3, the related logics operate to allow the data D0 to go to the shift register $1_0$, the data D3 to go to the shift register $1_1$, the data D2 to go to the shift register $1_2$, and the data D1 to go to the shift register $1_3$.

Figures 13A, 13B, 13C, 13D, 13E, 13F, 13G, 13H, 13I:
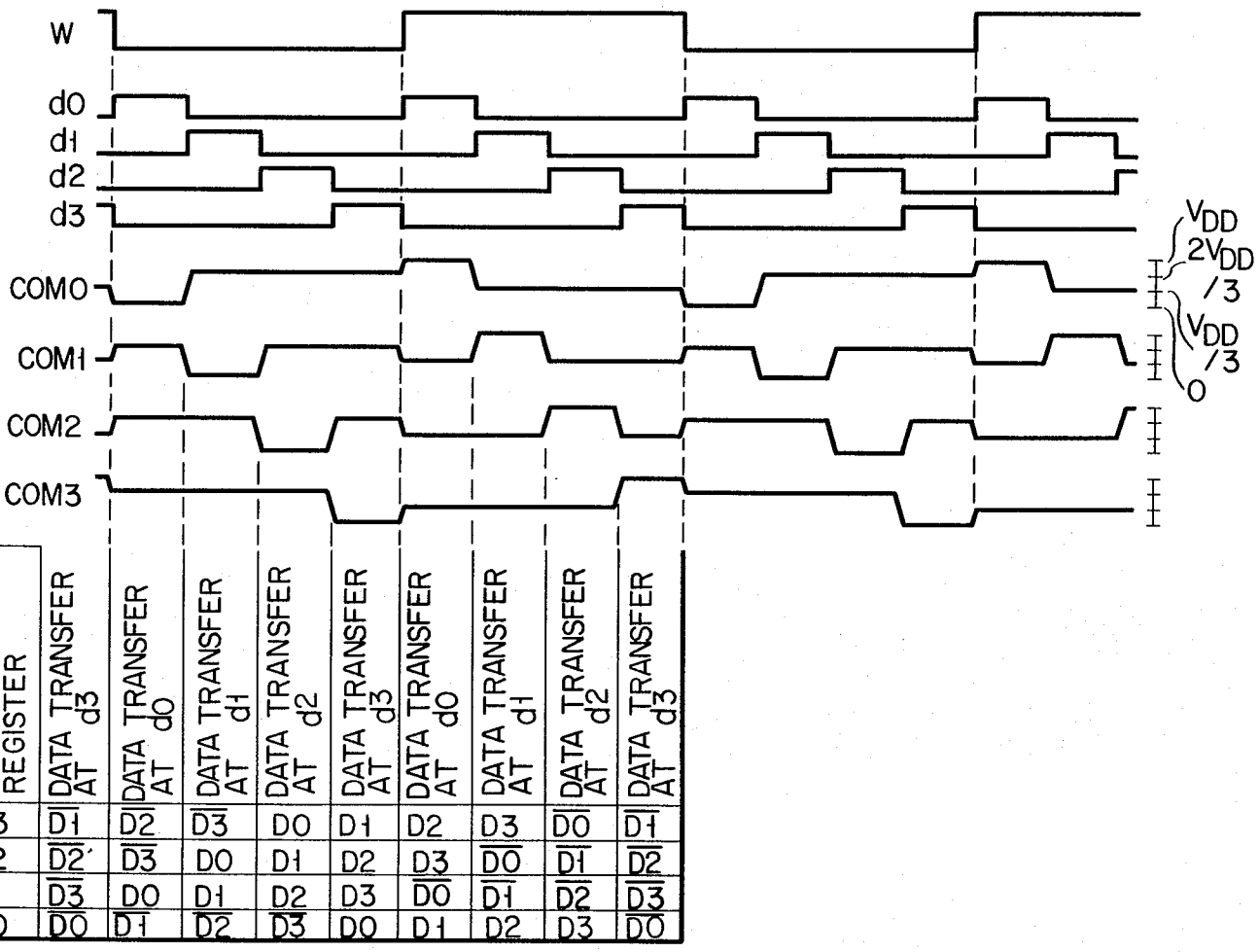
Figures 14A, 14B, 14C, 14D, 14E, 14F:
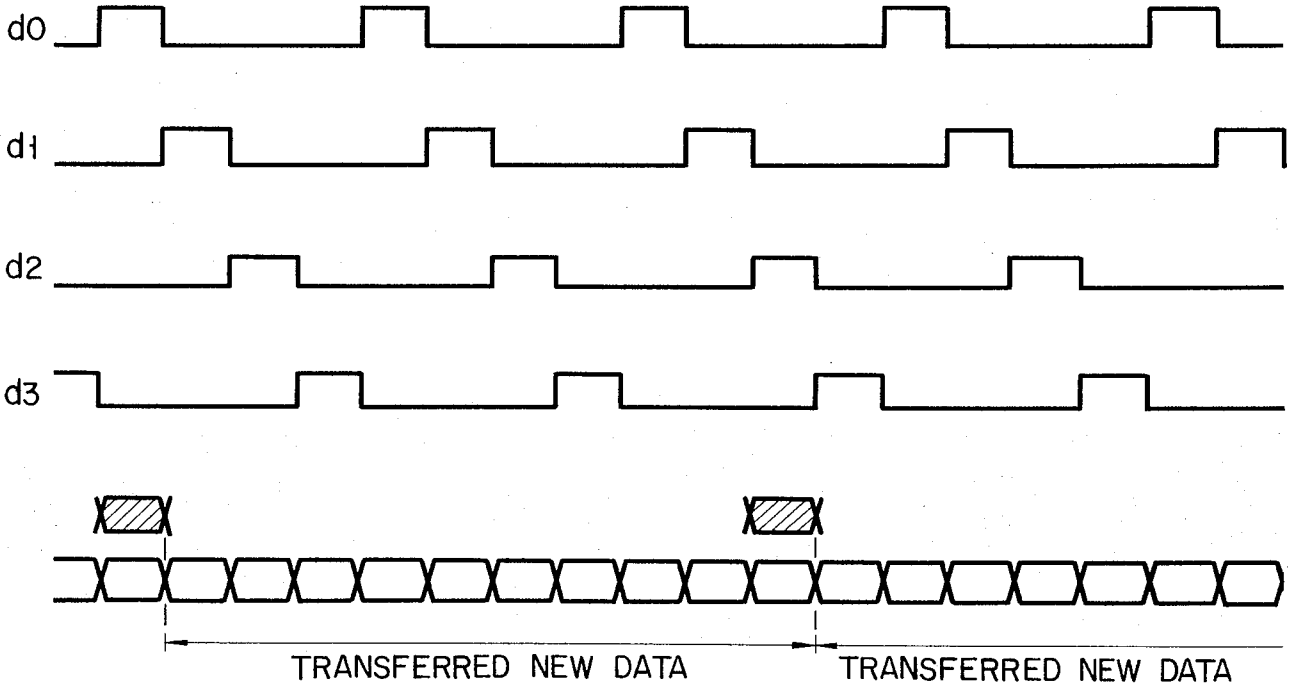

Relationships between the registers and the data loaded into them in such operations are tabulated in FIG. 13. When the signal m is logic "0", the AND gates $52_2$ to $55_2$ in the multiplexers $4_0$ to $4_3$ are enabled and the remaining AND gates of the multiplexers are disabled through the AND gates 59 and 60. The result is the formation of a closed loop of shift registers $1_0$ to $1_3$. When the output signal from the AND gate 60 is logic "1", the gates $52_1$ to $55_1$ are enabled to allow the inverted signal $\overline{WI1}$ to $\overline{WI4}$ to go to the shift registers $1_0$ to $1_3$. When the output signal from the AND gate 59 is logic "1", the AND gates $52_0$ to $55_0$ pass the signals WI1 to WI4 to the shift registers $1_3$ to $1_0$ through inverters $61_0$ to $61_3$. The AND gates 59 and 60 are provided for loading signals with the opposite polarity to that of common electrode drive signals COM0 to COM3 into the shift registers $1_0$ to $1_3$. The subsequent data inversion is made by the inverters in the shift register loop. As seen from FIG. 13, the display data regularly changes with the change of the signals d0 to d3. Accordingly, the signals d0 to d3 are applied to the selector 42 and the data corresponding to those signals are loaded into the shift registers $1_0$ to $1_3$.

What we claim is:

1. A data transfer control device having an input terminal for receiving constant-formatted data and an output terminal for connection to a display having common electrodes, said data transfer control device comprising:

a plurality of shift registers for storing data and providing output signals to said output terminal;

means for receiving a common electrode selecting signal;

selector means, coupled to said input terminal and said common electrode selecting signal means, for receiving said constant-formatted data at said input terminal, for changing the arrangement of said constant-formatted data in accordance with said common electrode selecting signal, said selector means comprising a plurality of outputs for outputting said data with changed arrangements to a plurality of multiplexers; and;

means for receiving a mode selection signal;

wherein each one of said plurality of multiplexers is coupled to said mode selection signal receiving means and to a different one of said selector means outputs, and is further coupled to an input of a different one of said plurality of shift registers, said plurality of multiplexers including means, responsive to said mode selection signals, for either supplying said constant-formatted display data from said selector means to said shift registers or shifting the stored data in said shift registers in a closed loop.

2. A data transfer control device according to claim 1, wherein said selector means includes means for determining the polarity of the constant-formatted data to be supplied to said shift registers.

3. A data transfer controi device according to claim 1, wherein said selector means includes means for inverting said constant formatted data.

* * * * *